United States Patent [19]

Smith

[11] Patent Number: 4,776,255

[45] Date of Patent: Oct. 11, 1988

[54] MINEFIELD BREACHING

[76] Inventor: John L. C. Smith, 27 Scotland Farm Road, Ash Vale GU12 5JA, Great Britain

[21] Appl. No.: 98,187

[22] Filed: Sep. 18, 1987

[30] Foreign Application Priority Data

Sep. 19, 1986 [GB] United Kingdom ..... 8622646

[51] Int. Cl.[4] ..... F41F 1/00; F21H 11/00

[52] U.S. Cl. ..... 89/1.13; 89/1.11; 89/1.34

[58] Field of Search ..... 89/1.13, 1.11, 1.34; 42/105

[56] References Cited

U.S. PATENT DOCUMENTS

| | | | |
|---|---|---|---|
| 3,242,862 | 3/1966 | Stegbeck et al. | 89/1.13 X |
| 3,496,580 | 2/1970 | Gulmon et al. | 42/105 X |
| 3,583,087 | 6/1971 | Huebner | 42/105 |
| 3,620,162 | 11/1971 | King | 42/105 X |
| 3,724,319 | 4/1973 | Zabelka et al. | 89/1.13 |
| 4,294,157 | 10/1981 | Stancil | 89/1.34 |
| 4,683,797 | 8/1987 | Wittbrodt | 89/1.13 |
| 4,689,912 | 9/1987 | Gillum | 42/105 |

FOREIGN PATENT DOCUMENTS

| | | | |
|---|---|---|---|
| 2226064 | 11/1974 | France | 89/1.13 |
| 2226065 | 11/1974 | France | 89/1.13 |

*Primary Examiner*—David H. Brown

*Attorney, Agent, or Firm*—Scrivener and Clarke

[57] ABSTRACT

A minefield breaching system comprises a projectile which is fired by trapping a round from a rifle or light mortar, and which carries behind it a length of explosive line. The end of the explosive line remote from the projectile is connected to a length of non-explosive line, the free end of which remains at the position of the user of the system. The projectile is in use fired to carry the explosive line over the minefield and the explosive line is then pulled back by means of the non-explosive line to permit an initiation set to be connected to the proximal end of the explosive line.

3 Claims, 4 Drawing Sheets

MINEFIELD BREACHING

The present invention relates to apparatus for use in breaching a minefield, i.e. clearing a safe path through a minefield, and in particular to apparatus of this type which can readily be carried and used by infantry soldiers.

The clearance of safe paths through minefields represents a long standing and continuing military problem. There are three principal techniques presently available. The first is to explore a path through the minefield by manually feel and by probing for buried mines. This is dangerous and slow. The second is to use a hand held mine detector to explore a path through the minefield. This is unsafe since not all mines can be detected by this technique. The third is to use explosives to detonate or hurl aside mines along a path through the minefield. The present invention is an improvement of this third technique.

There are presently available devices for propelling an explosive line charge across a minefield and for detonating the line charge to blast a path through the minefield. The line charge is, in these systems, propelled by one or more rockets at the head of the explosive line. For the clearance of minefields to allow the passage of heavy vehicles such as main battle tanks, the explosive line involved is so heavy that it needs to be propelled by several rockets and a substantial trailer is needed to contain the rocket launcher and the explosive line charge.

For dealing with anti-personnel mines, a more portable system of the same general nature is available. This comprises two large cylinders each mounted to a back pack whereby they may be carried by a team of two infantry soldiers. The first contains a rocket motor and a length of explosive line and the second contains a further length of explosive line which must be linked to that contained in the first cylinder by a connector before use. Whilst this system is satisfactory for use in breaching a minefield from a starting point to which safe access can be gained, so that the necessary equipment and personnel can be specifically brought to the starting point, it is too large and cumbersome to form part of the standard equipment of a foot patrol, and accordingly is quite unsuitable for dealing with a major problem of foot patrols, namely that the patrol may without warning find itself somewhere within a minefield.

If a foot patrol does, without realising it, enter a minefield, the first indication of the existence of the minefield is usually the detonation of a single anti-personnel mine and resultant casualty. There is no indication of any safe path in any direction from the spot where this occurs. It is of no assistance to the patrol to have minefield clearance apparatus available even a short distance away because there is no safe route to it. Accordingly, what is required in that situation is a minefield clearance device which can be carried sufficiently easily for it to be part of the standard equipment of any group of infantry soldiers or indeed any individual soldier or group of soldiers likely to be acting as an isolated unit. The device previously available for the penetration of anti-personnel minefields is wholly unsuitable to meet this need since it fully occupies the carrying capacity of two infantrymen and so encumbers them that they cannot effectively play any normal role in their unit. It will therefore only be carried by specialised personnel and an ordinary infantry section will not have the device when surprised by finding themselves in a minefield whose presence was unsuspected.

We have now devised a minefield breaching system which is sufficiently small and light in weight to be carried by a foot soldier and which is sufficiently simple and effective to enable an individual soldier to clear an anti-personnel mine free path several hundred meters in length, in any desired direction, starting from the position of the soldier.

According to the invention there is provided a minefield breaching system comprising a projectile adapted to be mounted on a rifle or light mortar and to be projected from a region in a desired direction by firing a round from the rifle or light mortar into the projectile whereby the energy of the round is transferred to the projectile to propel the projectile; a length of non-explosive material connected at one end thereof to the projectile and at the other end thereof to one end of an explosive line; a non-explosive line connected to the other end of the explosive line; and initiation means adapted to be connected to the explosive line to provide selective denotation thereof by a soldier using the breaching system.

In use, the projectile is connected to one end of the explosive line by the length of non-explosive material, and the projectile is mounted on a rifle or light- mortar. The end of the non-explosive line opposite to that connected to the explosive line is anchored by any suitable means and the rifle or light mortar is aimed and discharged to propel the projectile in the desired direction, towing behind it, in series, the length of non-explosive material, the explosive line, and the non-explosive line.

The weight of the various components of the system is selected so that the projectile will carry the entire length of the explosive line, together with at least part of the non-explosive line in the desired direction. Accordingly, when the projectile, non-explosive material, explosive line, and non-explosive line fall to the ground the end of the explosive line nearer to the soldier will be spaced some distance from the soldier. The soldier may then pull the explosive line back towards him using the non-explosive line so that the proximal end of the explosive line is within reach of the soldier. This action is most important since firstly it straightens the explosive line, and secondly it places the explosive line in the optimum position for safe selective detonation by the soldier. When the explosive line has been correctly positioned the soldier will detonate the explosive line using the initiation means forming part of the system. The initiation means may comprise a conventional detonator which can be taped or clipped to the explosive line and fired electrically from a battery provided as part of the initiation means, or by means of safety fuse which can be lit by means of a match or safety fuse igniter.

The invention has a number of features which render it suitable for the intended purpose, and distinguish the invention from prior art minefield breaching systems. Firstly, the system is powered—i.e. the projectile is launched, using either the personal weapon of the soldier, or using a light mortar of the type commonly carried by a foot patrol. In the case of a mortar launched system, a smoke-bomb may be used to propel the projectile. In the case of a rifle launched system, a standard round will be used to launch the projectile. Accordingly, the weight and complexity of existing rocket propelled systems is avoided, and this reduces substantially the total weight of the system rendering it capable of being carried as part of the standard equipment of a foot patrol.

The use of a selective initiation system, in association with the length of non-explosive line is particularly important since it enables the soldier to straighten the length of explosive line prior to detonation, thereby providing a straight path which can easily be followed, and it enables the explosive line to be placed at an optimum position in relation to the soldier so the clear path starts as close as possible to the soldier, but at the same time the detonation of the explosive line does not itself endanger the soldier. This contrasts with conventional rocket launched minefield clearance explosive systems which detonate automatically upon touching the ground, resulting in a path which is probably not straight, and which starts from a point spaced a substantial distance from the launching site. This method of straightening the explosive line is extremely important for use at night when it is most desirable for the soldier to walk in a straight line.

The explosive line is preferably of the type comprising a plastics outer case filled with a continuous length of explosive. Material of this general type is used extensively in demolition work and is commonly known as "det. cord". However, the mass of explosive per unit length of the explosive line used in the present invention is preferably higher than that used in conventional det. cord, thereby providing a more powerful explosive charge to provide for effective mine clearance.

The length of explosive line provided in the system may typically be from 25–300 m, with a particularly length of 25–100 m for the rifle system and 25–250 m for the mortar system.

The system as supplied to a soldier may comprise a plurality of projectiles together with one or more lengths of explosive line and a plurality of initiation sets. This will enable a soldier to clear a path equal to the total length of explosive line provided in a number of relatively short steps, the number of steps being determined by the number of projectiles and initiation sets provided.

The invention will be better understood from the following description of preferred embodiments thereof, given by way of example only, reference being had to the accompanying drawings, wherein FIG. 1 schematically illustrates a first embodiment of the invention prepared for firing;

Figure 1:
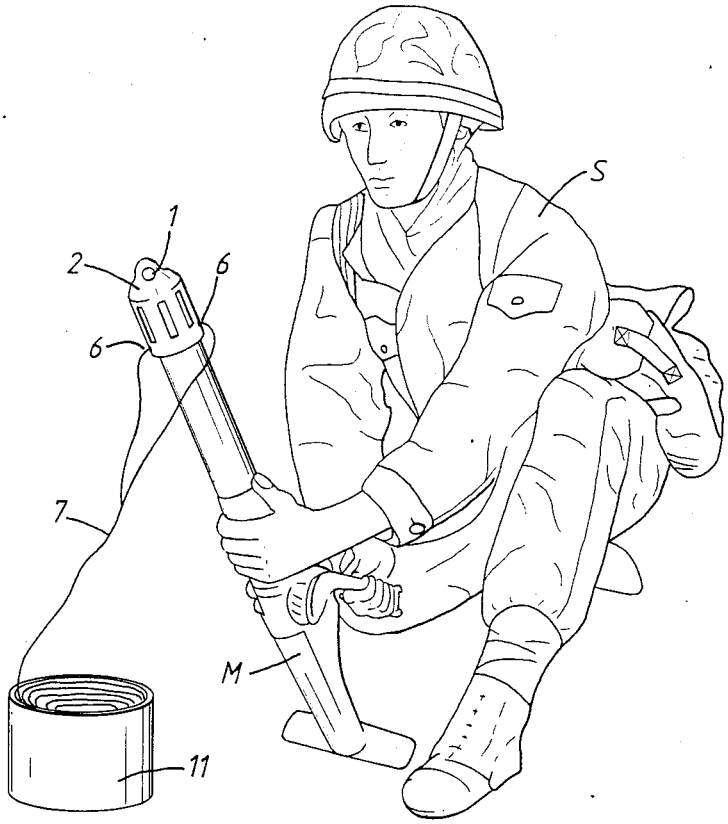
Figure 2:
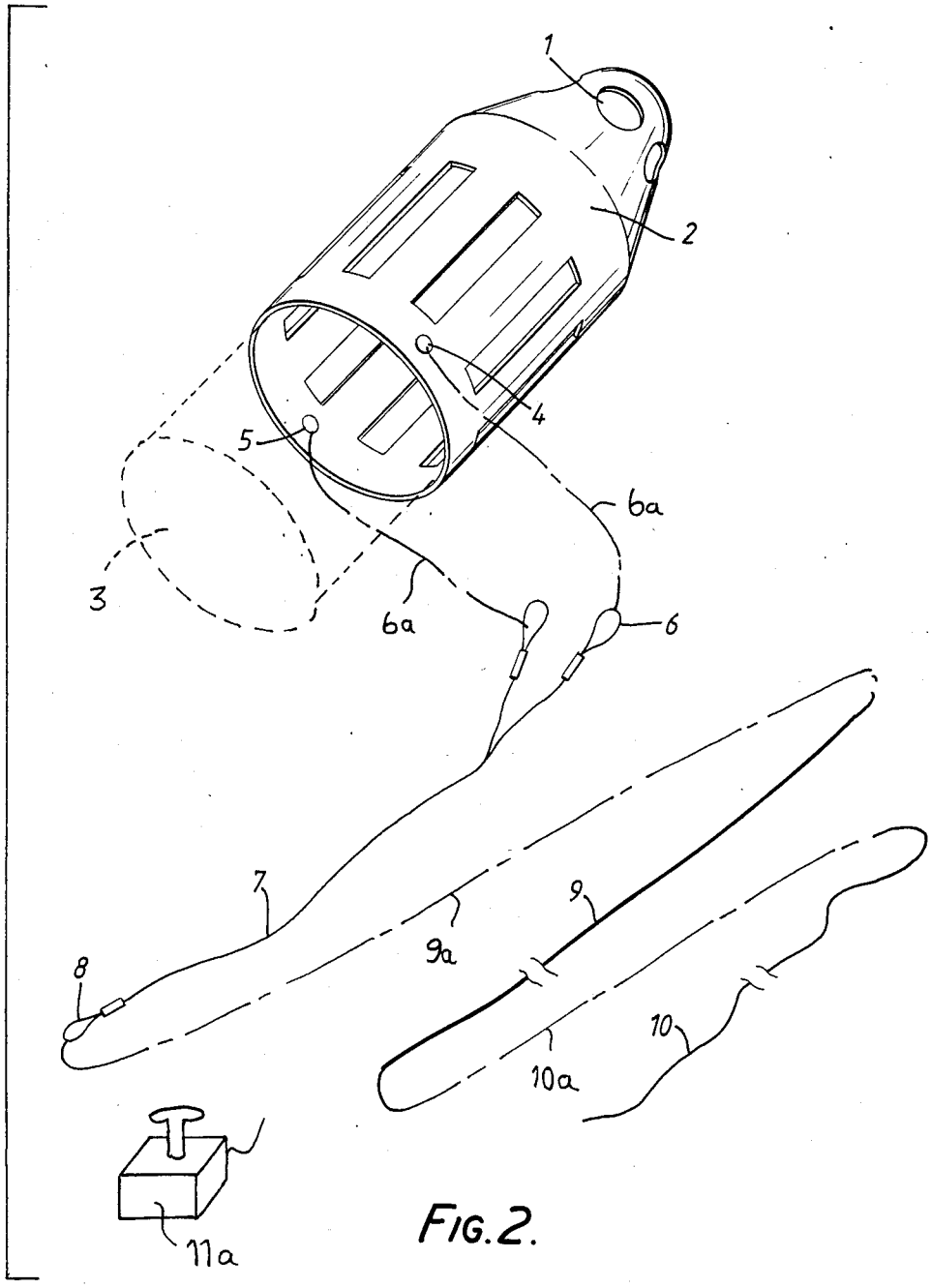
FIG. 2 illustrates the components of the system of FIG. 1.

Referring firstly to FIGS. 1 and 2 there is illustrated, a first embodiment of the invention adapted to be launched from a region by a light mortar M of the type commonly carried by an infantry foot patrol. The illustrated embodiment of the invention comprises a projectile 2 which is mounted over the muzzle of the mortar M to trap a smoke-bomb 3 fired from the mortar. The projectile 2 includes a plurality of gas escape holes 1 whereby the projectile will not be blown from the muzzle of the mortar by the advancing smoke-bomb, but rather will "catch" the smoke-bomb as it leaves the muzzle of the mortar, whereby the smoke-bomb will carry the projectile in the desired direction.

A length of non-explosive material 7, preferably a metal wire line is as indicated by the phantom lines 6*a* in FIG. 2 connected by way of loops 6 to suitable fixings 4,5 on the skirt of the projectile 2. The end of the wire line 7 remote from the projectile is connected to one end of a coil of explosive line 9 as indicated by the phantom line 9*a* in FIG. 2. This can conveniently be accomplished by providing a loop 8 at the end of the wire line 7, and passing the explosive line through the loop prior to fixing, e.g. by means of adhesive tape provided as part of the system.

The end of the explosive line 9 remote from the projectile is as indicated by the phantom line 10*a* connected by suitable means to a length of non-explosive line 10, for example a length of synthetic plastics cord.

The explosive line 7 and non-explosive line 10 are coiled within a container 11 in such a manner that they can readily be un-coiled by the projectile. In order that at least a portion of the non-explosive line will be accessible to a person in the launch region, the line 10 is of sufficient length to ensure that under all conditions the end of the line 10 remote from the explosive line 9 will not be carried away from the soldier, or in the alternative means can be provided for anchoring the free end of the line 10. For example the end of the non-explosive line remote from the explosive line may be secured to the container 11 which may be secured to the ground by means of metal piquets or by the soldier placing his foot on the lid of the container.

In use, the soldier S prepares the system for use by loading a smoke-bomb into the mortar M and positioning the projectile 2 over the muzzle of the launcher as illustrated. The mortar is then aimed and fired causing the projectile to travel in the desired direction carrying with it the explosive line 9 and non-explosive line 10. The soldier then grasps the non-explosive line and pulls on it to retrieve the proximal end of the explosive line 9. This action, straightens the explosive line and brings the proximal end of the explosive line to an optimum position to enable the soldier to connect to it an initiation set 11*a* which may be of any conventional form, for example an electrical detonator or a detonator fired by means of safety fuse.

The use of the length 7 of non-explosive material is important since firstly it acts as a shock absorber to relieve the explosive line of the strains imposed by the very rapid acceleration which the projectile 2 undergoes as the fired mortar round is trapped, and secondly it ensures that if the projectile, upon landing, strikes and detonates a mine, this will not result in premature detonation of the explosive line.

The components of the system are preferably packed within the container 11 so that the container 11, as supplied, forms a complete system for minefield clearance. In this case, the detonator is preferably contained within a suitable safety enclosure within the container 11 to obviate the possibility of premature detonation of the explosive line.

Figure 3:
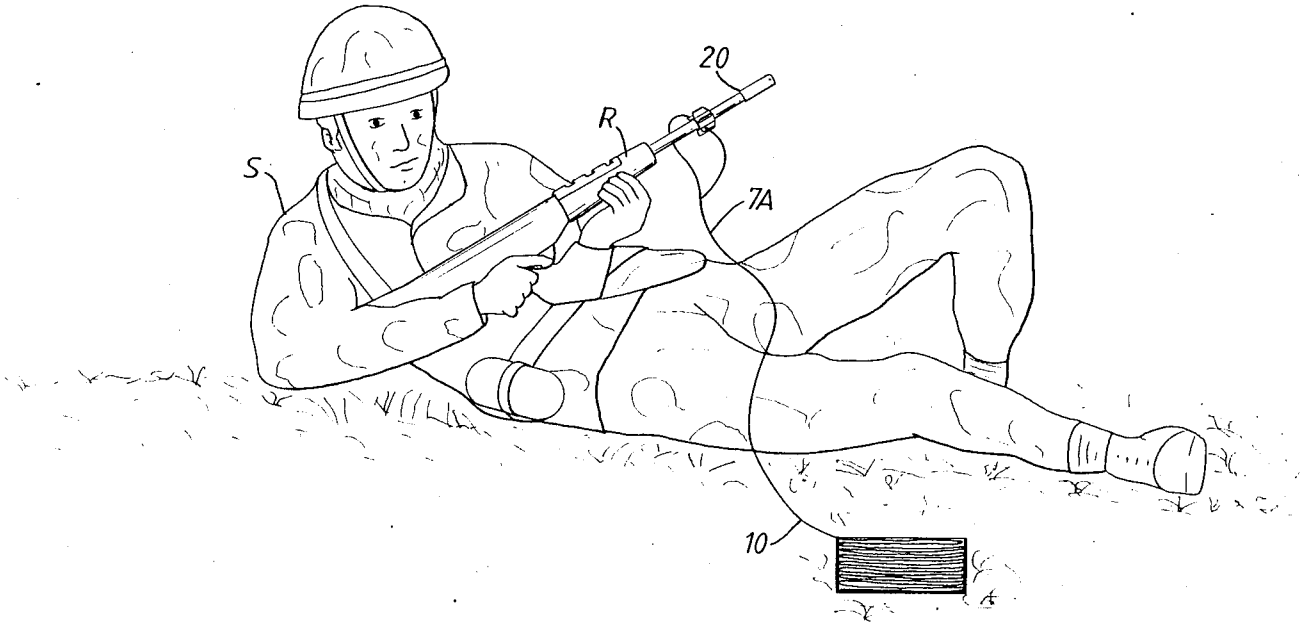
FIG. 3 illustrates a second embodiment of the invention prepared for firing.
Figure 4:
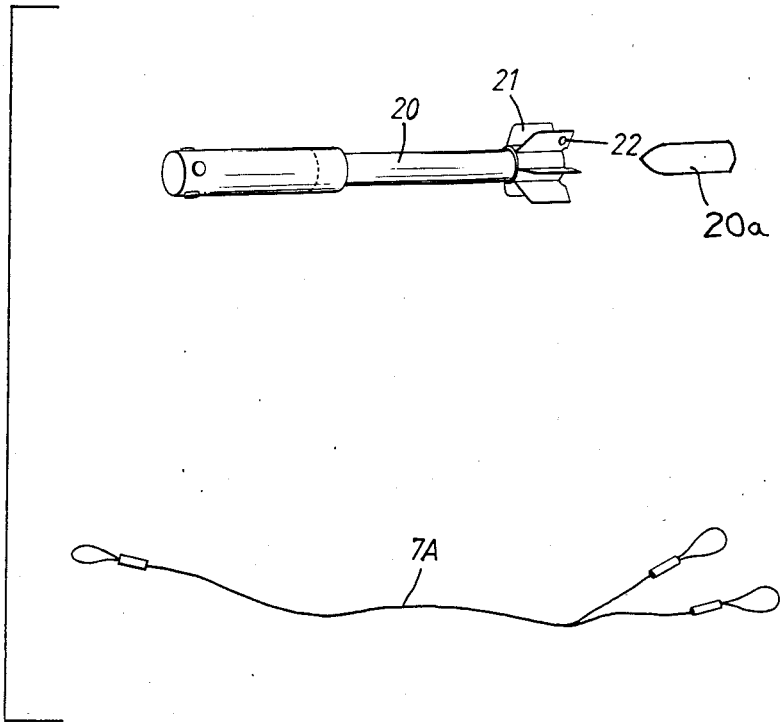
FIG. 4 illustrates the components of the embodiment of FIG. 3.

Referring now to FIGS. 3 and 4 a rifle launched version of the invention is illustrated. In this case, the projectile comprises a "bullet trap" 20 which is a push-fit over the muzzle of a rifle and which can be launched by firing a conventional live round 20*a* from the rifle into the bullet trap. The bullet trap 20 includes tail fins 21 to assist in guidance of the projectile, two of the tail fins being provided with means 22 for attaching a length of non-explosive material 7A corresponding generally to the length of material 7 of the above described embodiment. The remaining components and method of operation of the embodiment of FIG. 3 correspond to those of the above described embodiment although, of course, it will be appreciated that the weight and strength of the various components of the system may be different from those of a system specifically designed for mortar launching. In general, the mortar launched system will be capable of carrying a heavier weight of explosive line than the rifle launched system, and would accordingly be capable of clearing a broader and/or longer path. If desired two lengths of explosive line may be towed by the projectile in order to increase the power of the charge per unit length of path cleared.

Whilst each individual soldier may use his personal minefield breaching system to provide an individual safe path through the minefield it may under certain circumstances be preferable to use a mortar launched system to provide a main path from the position of the mortar to the edge of a minefield, and for the individual soldiers of a patrol to use their own personal breaching systems to clear a path leading to the main path as cleared by the mortar launched system.

In addition to the major components of the system as outlined above, each container may contain supplementary components, for example a roll of adhesive tape, fuzee matches, luminous path markers, etc.

I claim:

1. A minefield breaching system comprising a projectile adapted to be mounted on a rifle or light mortar and to be projected from a region in a desired direction by firing a round from the rifle or light mortar into the projectile whereby the energy of the round is transferred to the projectile to propel the projectile; a length of non-explosive material connected at one end thereof to the projectile, an explosive line comprising an outer casing filled with a continuous length of explosive, the other end of said non-explosive material being connected to the one end of said explosive line; a non-explosive line connected at one end to the other end of said explosive line; and initiation means adapted to be connected to the explosive line to provide selective detonation by a soldier in said region using the breaching system, said non-explosive line having a length such that, following projection of said projectile, non-explosive material and explosive line, a portion of said non-explosive line is at all times accessible to a soldier in said region whereby said non-explosive line may be manually pulled to straighten said explosive line and bring its proximal end to an optimum position relative to said region to enable the connection thereto of said initiation means.

2. A minefield breaching system according to claim 1 wherein the length of non-explosive material is a length of steel wire rope and the non-explosive line is a length of synthetic plastics cord.

3. A minefield breaching system according to claim 1 or claim 2 wherein the length of non-explosive material is formed with loops at the ends thereof for respective attachment to the projectile and the explosive line.

* * * * *